US005660125A

United States Patent [19]

Tanca

[11] Patent Number: 5,660,125

[45] Date of Patent: Aug. 26, 1997

[54] CIRCULATING FLUID BED STEAM GENERATOR $NO_x$ CONTROL

[75] Inventor: Michael C. Tanca, Tariffville, Conn.

[73] Assignee: Combustion Engineering, Inc., Windsor, Conn.

[21] Appl. No.: 435,707

[22] Filed: May 5, 1995

[51] Int. Cl.[6] ..... F23J 11/00

[52] U.S. Cl. ..... 110/345; 122/4 D

[58] Field of Search ..... 122/4 D; 110/345, 110/347, 245

[56] References Cited

U.S. PATENT DOCUMENTS

| | | | |
|---|---|---|---|
| 4,962,711 | 10/1990 | Yamauchi et al. | 122/4 D |
| 5,297,622 | 3/1994 | Brännström et al. | 122/4 D |
| 5,345,883 | 9/1994 | Panos | 122/4 D |

*Primary Examiner*—Noah P. Kamen
*Attorney, Agent, or Firm*—Arthur E. Fournier, Jr.

[57] ABSTRACT

A method for enhancing the minimization of $NO_x$ control in a circulating fluid bed steam generator into which there is injected fuel, fluidizing air, a lower level of combustion air and an upper level of combustion air. The fuel is injected at a first location, the fluidizing air is injected at a second location, the lower level of combustion air is injected at a third location and the upper level of combustion air is injected at a fourth location. In order to enhance the minimization of $NO_x$ control within a circulating fluid bed steam generator the lower level combustion air as well as the upper level combustion air are each biased in the horizontal plane as well as the vertical plane so as to thereby control the lower level combustion air flow and the upper level combustion air flow such that local stoichiometries within the circulating fluid bed steam generator are maintained within a range of 70% stoichiometry to 90% stoichiometry.

8 Claims, 8 Drawing Sheets

CIRCULATING FLUID BED STEAM GENERATOR $NO_x$ CONTROL

BACKGROUND OF THE INVENTION

This invention relates to circulating fluid bed steam generators, and more specifically, to a method of enhancing the minimization of $NO_x$ formation in circulating fluid bed steam generators.

It has long been known in the prior art to employ vertical fuel and air staging in fluid bed units. By way of exemplification and not limitation in this regard, reference may be had to U.S. Pat. No. 4,165,717 entitled "Process For Burning Carbonaceous Materials," which issued on Aug. 28, 1979. In accordance with the teachings of U.S. Pat. No. 4,165,717, carbonaceous material is introduced into a fluid bed in an upright reactor. This carbonaceous material is fluidized in the fluid bed with a primary fluidizing gas introduced at the bottom of the fluid bed. A secondary gas is introduced into the fluid bed at a level above that at which the primary gas is introduced and above the bottom of the fluid bed. Thus, combustion is carried out in the presence of oxygen-containing gases, which are supplied in two partial streams at different height levels of the upright fluid bed, and at least one of the partial streams is used as a combustion-promoting secondary gas and is fed into the combustion chamber on one plane or a plurality of superposed planes. As such, because all oxygen-containing gases required for the combustion are divided into at least two partial streams, which are supplied on different levels, the combustion is effected in two stages. Further, because of the substochiometric combustion in a first lower zone and an afterburning in a second higher zone, there results a "soft" combustion, which eliminates local overheating so that formation of crusts or clogging is avoided and the formation of nitrogen oxide is limited to values below 100 ppm.

As suggested by the preceding, the formation of $NO_x$ can be minimized by vertically staging the mixing of fuel and air. This is done in an effort to ensure that nitrogen in the fuel is not oxidized to form $NO_x$. The effect of such staging is that there is a staging within the circulating fluid bed steam generator of the combustion that takes place therewithin. In accordance with such staging of the combustion within the circulating fluid bed steam generator, a portion of the fuel is partially burned in the lower furnace of the circulating fluid bed steam generator. Also, for purposes of oxidizing the remaining fuel and the resulting gases generated during combustion, the circulating fluid bed steam generator is provided with overfire air. This overfire air is provided above the location whereat the circulating fluid bed steam generator is provided with fuel.

Thus, by way of summary the conventional manner of staging combustion in a circulating fluid bed steam generator is to feed primary air and/or lower secondary air below the chutes, which commonly are utilized for the purpose of feeding fuel into the circulating fluid bed steam generator. This primary air and/or lower secondary air is fed into the circulating fluid bed steam generator in order to effectuate therewith the partial burning of the fuel in a reducing zone to form $N_2$ from the nitrogen in the fuel. Overfire or upper secondary air is fed to the circulating fluid bed steam generator above the fuel chutes in order to combust the remaining fuel and reducing gases to achieve low carbon losses, low CO emissions and fully oxidized $SO_2$ so as to achieve optimal sulfur capture by the sorbent, which for this purpose in accordance with conventional practice is introduced into the circulating fluid bed steam generator.

In accordance with the foregoing, all fuel/air staging is done in the vertical direction. The major difficulty with this is that it presumes that there is good mixing of the fuel and air along the horizontal plane of the circulating fluid bed steam generator. However, it has been found that in fact fuel and air are not well mixed along the horizontal plane of the circulating fluid bed steam generator. Namely, because the fuel and air are not well mixed along the horizontal plane of the circulating fluid bed steam generator, it has been found that some very reducing zones and some air-rich zones occur along the same horizontal plane at the same elevation of the circulating fluid bed steam generator.

Heretofore, in order to extend, beyond that attainable through vertical staging of the mixing of the fuel and air within the circulating fluid bed steam generator, the extent to which $NO_x$ emissions from a circulating fluid bed steam generator are reduced, the practice commonly followed by those in the industry has been to provide the circulating fluid bed steam generator with additional means operative to remove $NO_x$ subsequent to its formation within the circulating fluid bed steam generator. The prior art includes a number of different approaches that have been proposed for use for purposes of reducing $NO_x$ emissions or $N_2O$ emissions from a fluid bed unit. By way of exemplification and not limitation, one such prior art approach for reducing $NO_x$ emissions from a fluid bed unit is to be found set forth in U.S. Pat. No. 4,880,378 entitled "Combustion Plant With A Device For Reducing Nitrogen Oxides In Flue Gases," which issued on Nov. 14, 1989. In accordance with the teachings of U.S. Pat. No. 4,880,378, a fluid bed unit is provided with means for reducing nitrogen oxides in flue gases, the flue gases being generated as a consequence of the combustion of fuel and air within the fluid bed unit. This means with which the fluid bed unit is provided includes an injection device for injecting into the fluid bed unit a gaseous reducing agent comprising ammonia, and a catalyst arrangement, wherein the catalyst thereof contains elements of the iron group subjectible to a flue gas temperature in excess of 600 degrees C., disposed downstream of the injection device in the direction of flow of the flue gases.

By way of exemplification and not limitation, another such prior art approach for reducing $NO_x$ emissions from a fluid bed unit is to be found set forth in U.S. Pat. No. 5,382,418 entitled "Process For Removing Pollutants From Combustion Exhaust Gases," which issued on Jan. 17, 1995. More specifically, there is disclosed in U.S. Pat. No. 5,382,418 a process for removing the $NO_x$ from a flue gas, the flue gas being generated as a consequence of the combustion of coal, gas or fuel oil. In accordance with this process as set forth in U.S. Pat. No. 5,382,418, an absorbent containing $NH_3$ and a granular denitrating catalyst is admixed with a flue gas. This absorbent containing flue gas is then introduced into a fluid bed where the flue gas reacts with the absorbent to remove the $NO_x$ therefrom.

By way of exemplification and not limitation, yet another such approach for reducing $NO_x$ emissions from a fluid bed unit is to be found set forth in U.S. Pat. No. 5,178,101 entitled "Low $NO_x$ Combustion Process And System," which issued on Jan. 12, 1993. In accordance with the teachings of U.S. Pat. No. 5,178,101, a process and a system are provided wherein $N_2O$ emissions, in the course of $NO_x$ emissions being reduced, are simultaneously also reduced. More specifically, in accordance with the teachings of U.S. Pat. No. 5,178,101 the exhaust stream from a fluid bed unit is flowed through a thermal reaction zone in which fuel and air are burned in order to thereby provide a modified heated stream that includes small quantities of combustibles and of oxygen. This modified heated stream is then in turn passed over a catalyst bed under overall reducing conditions, the quantity of oxygen in the stream being in stoichiometric excess of the amount of $NO_x$ and $N_2O$, but less than the amount of the combustibles, whereby the $NO_x$ and $N_2O$ are first oxidized to $NO_2$ and then the $NO_2$ is reduced by the excess combustibles.

By way of exemplification and not limitation, yet still another such approach, in this case directed to reducing $N_2O$ emissions, is to be found set forth in U.S. Pat. No. 5,048,432 entitled "Process And Apparatus For The Thermal Decomposition Of Nitrous Oxide," which issued on Sep. 17, 1991. In accordance with the teachings of U.S. Pat. No. 5,048,432, $N_2O$ is thermally decomposed by raising the temperature of the $N_2O$ containing effluent to at least about 1700 degrees F. The $N_2O$ containing effluent, which is intended to be subjected to the aforesaid treatment, is generated as a consequence of the combustion of fuel within a boiler, e.g., a fluid bed unit. The thermal decomposition of the $N_2O$ preferably is accomplished by disposing a heating means in the flow path of the effluent from the fluid bed unit. That is, in the case of a fluid bed unit this heating means allegedly for maximum efficiency is advantageously located downstream from the cyclone and upstream from the heat exchangers.

Although the methods, as set forth in the four issued U.S. patents to which reference has been had hereinbefore, for reducing the nitrogen-related emissions from fluid bed units have been demonstrated to be operative for their intended purpose, there has nevertheless been evidenced in the prior art a need for such nitrogen-related emissions reduction methods to be further improved. Namely, there has been evidenced in the prior art a need for a new and improved method for effectuating the reduction of nitrogen-related emissions from a circulating fluid bed steam generator, and, in particular, a new and improved method for effectuating the reduction of $NO_x$ from a circulating fluid bed steam generator. More specifically, a need is being evidenced in the prior art for a new and improved method that, rather than being operative for purposes of effectuating the reduction of $NO_x$ emissions from a circulating fluid bed steam generator by occasioning the removal of the $NO_x$ after the $NO_x$ has been formed therewithin, would be operative for purposes of effectuating the reduction of $NO_x$ emissions from a circulating fluid bed steam generator by enhancing the minimization of the formation of $NO_x$ within the circulating fluid bed steam generator such that since $NO_x$ is not being formed in the circulating fluid bed steam generator the need for the removal thereof is thus obviated.

To this end, there has been evidenced in the prior art a need for such a new and improved method of enhancing the minimization of $NO_x$ formation in circulating fluid bed steam generators that is characterized in a number of respects. One such characteristic is that such a new and improved method of enhancing the minimization of $NO_x$ formation in circulating fluid bed steam generators would render it unnecessary to effectuate the reduction of $NO_x$ emissions from a circulating fluid bed steam generator through the removal of $NO_x$ therefrom since the employment of the subject new and improved method would be operative to prevent the formation within the circulating fluid bed steam generator of $NO_x$ that would otherwise need to be removed. Another such characteristic is that such a new and improved method of enhancing the minimization of $NO_x$ formation in circulating fluid bed steam generators would render it unnecessary to provide a circulating fluid bed steam generator with selective non-catalytic $NO_x$ reduction equipment for purposes of effectuating therewith the reduction of $NO_x$ therefrom since the employment of the subject new and improved method would be operative to prevent the formation within the circulating fluid bed steam generator of $NO_x$ that would otherwise need to be removed through the use of such selective non-catalytic $NO_x$ reduction equipment. A third such characteristic is that such a new and improved method of enhancing the minimization of $NO_x$ formation in circulating fluid bed steam generators would render it unnecessary to provide a circulating fluid bed steam generator with selective catalytic $NO_x$ reduction equipment for purposes of effectuating therewith the reduction of $NO_x$ therefrom since the employment of the subject new and improved method would be operative to prevent the formation within the circulating fluid bed steam generator of $NO_x$ that would otherwise need to be removed through the use of such selective catalytic $NO_x$ reduction equipment. A fourth such characteristic is that such a new and improved method of enhancing the minimization of $NO_x$ formation in circulating fluid bed steam generators would render unnecessary the injection of ammonia into the circulating fluid bed steam generator for purposes of effectuating therewith the reduction of $NO_x$ therefrom since the employment of the subject new and improved method would be operative to prevent the formation within the circulating fluid bed steam generator of $NO_x$ that would otherwise necessitate such injection of ammonia for its removal. A fifth such characteristic is that such a new and improved method of enhancing the minimization of $NO_x$ formation in circulating fluid bed steam generators would render unnecessary the injection of urea into the circulating fluid bed steam generator for purposes of effectuating therewith the reduction of $NO_x$ therefrom since the employment of the subject new and improved method would be operative to prevent the formation within the circulating fluid bed steam generator of $NO_x$ that would otherwise necessitate such injection of urea for its removal. A sixth such characteristic is that such a new and improved method of enhancing the minimization of $NO_x$ formation in circulating fluid bed steam generators would render it much less costly to provide and operate a circulating fluid bed steam generator because the employment of the subject new and improved method would render it unnecessary to provide the circulating fluid bed steam generator with additional means to effectuate therewith the reduction of $NO_x$ therefrom since the subject new and improved method would be operative to prevent the formation within the circulating fluid bed steam generator of $NO_x$ that would otherwise need to be removed through the use of such additional means. A seventh such characteristic is that such a new and improved method of enhancing the minimization of $NO_x$ formation in circulating fluid bed steam generators would render it much simpler to provide and operate a circulating fluid bed steam generator because the employment of the subject new and improved method would render it unnecessary to provide the circulating fluid bed steam generator with additional means to effectuate therewith the reduction of $NO_x$ therefrom since the subject new and improved method would be operative to prevent the formation within the circulating fluid bed steam generator of $NO_x$ that would otherwise need to be removed through the use of such additional means. An eighth such characteristic is that such a new and improved method of enhancing the minimization of $NO_x$ formation in circulating fluid bed steam generators would be suitable for application in new circulating fluid bed steam generators. A ninth such characteristic is that such a new and improved method of enhancing the minimization of $NO_x$ formation in circulating fluid bed steam generators would be suitable to be retrofitted for application in existing circulating fluid bed steam generators.

It is, therefore, an object of the present invention to provide a new and improved method for effectuating therewith the reduction of $NO_x$ emissions from a circulating fluid bed steam generator.

It is another object of the present invention to provide such a new and improved method for effectuating therewith the reduction of $NO_x$ emissions from a circulating fluid bed steam generator wherein the reduction of $NO_x$ emissions from the circulating fluid bed steam generator is accomplished as a consequence of enhancing the minimization of $NO_x$ formation in the circulating fluid bed steam generator.

It is still another object of the present invention to provide such a new and improved method of enhancing the minimization of $NO_x$ formation in a circulating fluid bed steam generator whereby the utilization thereof obviates the necessity of providing the circulating fluid bed steam generator with selective non-catalytic $NO_x$ reduction equipment.

Another object of the present invention is to provide such a new and improved method of enhancing the minimization of $NO_x$ formation in a circulating fluid bed steam generator whereby the utilization thereof obviates the necessity of providing the circulating fluid bed steam generator with selective catalytic $NO_x$ reduction equipment.

A still another object of the present invention is to provide such a new and improved method of enhancing the minimization of $NO_x$ formation in a circulating fluid bed steam generator whereby the utilization thereof obviates the necessity of having to inject either ammonia or urea into the circulating fluid bed steam generator in order to thereby effectuate therewith the reduction of $NO_x$ from the circulating fluid bed steam generator.

A further object of the present invention is to provide such a new and improved method of enhancing the minimization of $NO_x$ formation in a circulating fluid bed steam generator which is not disadvantageously characterized by the fact that the utilization thereof occasions ammonia slip from the circulating fluid bed steam generator since the utilization thereof obviates the necessity to inject into the circulating fluid bed steam generator either ammonia or urea from whence the ammonia slip would originate.

A still further object of the present invention is to provide such a new and improved method of enhancing the minimization of $NO_x$ formation in a circulating fluid bed steam generator which is not disadvantageously characterized by the fact that the utilization thereof occasions the contamination of the ash thereof with ammonia or urea since the utilization thereof obviates the necessity to inject into the circulating fluid bed steam generator either ammonia or urea from whence the source of the contamination of the ash would originate.

Yet an object of the present invention is to provide such a new and improved method of enhancing the minimization of $NO_x$ formation in a circulating fluid bed steam generator which renders the circulating fluid bed steam generator much simpler to provide and operate since the utilization thereof obviates the necessity to provide the circulating fluid bed steam generator with any additional means that would otherwise be required in order to effectuate the removal of $NO_x$ from the circulating fluid bed steam generator to the same extent.

Yet a further object of the present invention is to provide such a new and improved method of enhancing the minimization of $NO_x$ formation in a circulating fluid bed steam generator which renders the circulating fluid bed steam generator much less costly to provide and operate since the utilization thereof obviates the necessity to provide the circulating fluid bed steam generator with any additional means that would otherwise be required in order to effectuate the removal of $NO_x$ from the circulating fluid bed steam generator to the same extent.

Yet another object of the present invention is to provide such a new and improved method of enhancing the minimization of $NO_x$ formation in a circulating fluid bed generator that is suitable for application in new circulating fluid bed steam generators and is equally suitable to be retrofitted for application in existing circulating fluid bed steam generators.

SUMMARY OF THE PRESENT INVENTION

In accordance with the present invention there is provided a method for effectuating therewith the reduction of $NO_x$ emissions from a circulating fluid bed steam generator wherein the reduction of $NO_x$ emissions from the circulating fluid bed steam generator is accomplished as a consequence of enhancing the minimization of $NO_x$ formation in the circulating fluid bed steam generator. To this end, in accord with the subject method of enhancing the minimization of $NO_x$ formation in the circulating fluid bed steam generator the minimization of $NO_x$ formation is accomplished through the staging, both vertically and horizontally, of the combustion of the fuel and air within the circulating fluid bed steam generator. More specifically, primary air, i.e., fluidizing air, is fed into the circulating fluid bed steam generator through a floor grate. The function of this primary air, i.e., fluidizing air, is to fluidize the fuel, sorbent and ash within the circulating fluid bed steam generator. In addition to the primary air, i.e., fluidizing air, combustion air is also fed into the circulating fluid bed steam generator as lower secondary air and upper secondary air to provide the air required for proper combustion of the fuel within the circulating fluid bed steam generator as well as for $NO_x$ control. Fuel is made to enter the circulating fluid bed steam generator through one or more fuel chutes located, as viewed in the vertical direction, between where the lower secondary air and the upper secondary air are fed into the circulating fluid bed steam generator. In order to minimize $NO_x$ formation within the circulating fluid bed steam generator, both the lower secondary air flow and the upper secondary air flow are controlled both in the vertical direction and in the horizontal direction in the course of there being introduced into the circulating fluid bed steam generator. This controlling of both the lower secondary air flow and the upper secondary air flow in both the vertical direction and the horizontal direction is for the purpose of limiting $NO_x$ formation to the minimum by maintaining within the circulating fluid bed steam generator local stoichiometries, which are not conducive to ammonia formation, i.e., low stoichiometries, or which are not conducive to direct $NO_x$ formation, i.e., high stoichiometries. In accordance with the subject method of the present invention, the lower secondary air flow as well as the upper secondary air flow is biased in the horizontal plane as well as the vertical plane in order to thereby control the stoichiometry locally within the circulating fluid bed steam generator. Moreover, in accord with the subject method of the present invention this biasing of the lower secondary air flow and the upper secondary air flow is accomplished through the use of local dampers, which are suitably provided for this purpose in the supply lines through which the lower secondary air flow and the upper secondary air flow, respectively, are each fed into the circulating fluid bed steam generator. To thus summarize, if the stoichiometries within the circulating fluid bed steam generator can be controlled therewithin locally to be within a range of approximately 70% stoichiometry to 90% stoichiometry, overall $NO_x$ formation can thereby be kept to a minimum within the circulating fluid bed steam generator.

DESCRIPTION OF THE PREFERRED EMBODIMENT

Figure 1:
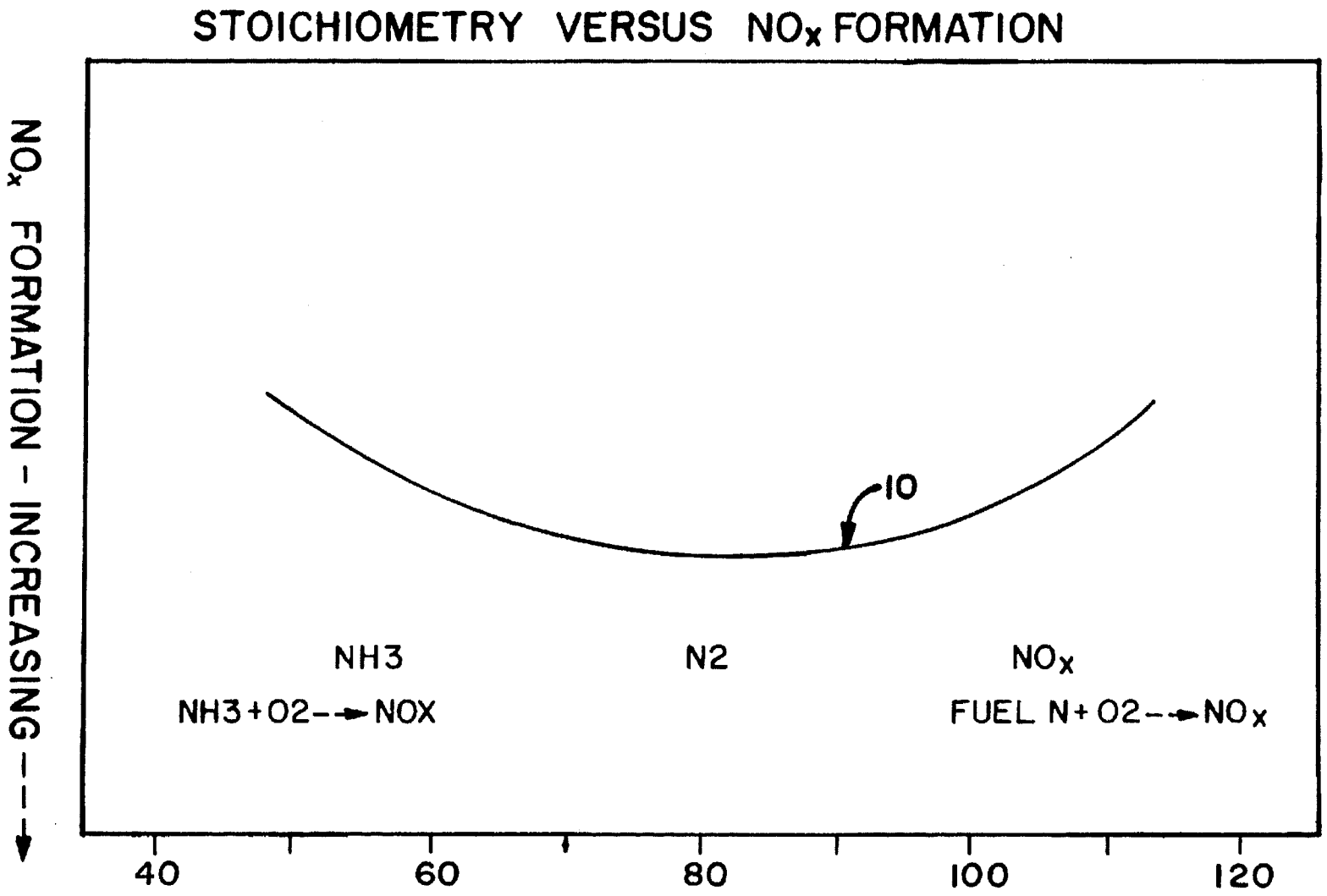
FIG. 1 is a graphical depiction of the effect that stoichiometry has on $NO_x$ formation within a circulating fluid bed steam generator.

Referring now to the drawing, and more particularly to FIG. 1 thereof, there is set forth therein a graphical illustration of the effect that stoichiometry has on $NO_x$ formation within a typical circulating fluid bed steam generator. This graphical illustration is depicted by the curve, which is denoted generally in FIG. 1 by the reference numeral 10. As will be readily apparent from a reference to FIG. 1 of the drawing, the amount of $NO_x$ increases at stoichiometries below 70%. This is due to the fact that ammonia is produced as the stoichiometry decreases to very low levels, i.e., becomes very substoichiometric. To this end, if the conditions locally under which combustion occurs within the circulating fluid bed steam generator become too substoichiometric, i.e., begin to decrease below 70% stoichiometry, ammonia is formed from the nitrogen in the fuel during the combustion of the fuel. This ammonia then is later easily oxidized to $NO_x$ in the upper region of the circulating fluid bed steam generator by virtue of the presence thereat of the combustion air, i.e., secondary air, which is fed into the circulating fluid bed steam generator.

On the other hand, if the conditions locally under which combustion occurs within the circulating fluid bed steam generator begin to increase above 90% stoichiometry, $NO_x$ again begins to increase due to rapid oxidation of the nitrogen in the fuel. Thus, referring again to FIG. 1 of the drawing it can be seen therefrom that the curve 10 is essentially flat between approximately 70% stoichiometry and approximately 90% stoichiometry, and that $NO_x$ formation is at its lowest for stoichiometries within the range of approximately 70% stoichiometry and approximately 90% stoichiometry. Accordingly, it is readily apparent from FIG. 1 of the drawing that in order to minimize both ammonia oxidation and direct nitrogen oxidation the stoichiometries locally within the circulating fluid bed steam generator must be kept within a range of approximately 70% stoichiometry and approximately 90% stoichiometries for purposes of effectuating the combustion of fuel therewithin. To this end, as can be seen from the curve 10 such a window of local stoichiometries, i.e., stoichiometries of between approximately 70% and approximately 90%, assures the maximum production of $N_2$ and concomitantly the minimum production of $NO_x$ from the combustion of fuel in the circulating fluid bed steam generator.

Figure 2:
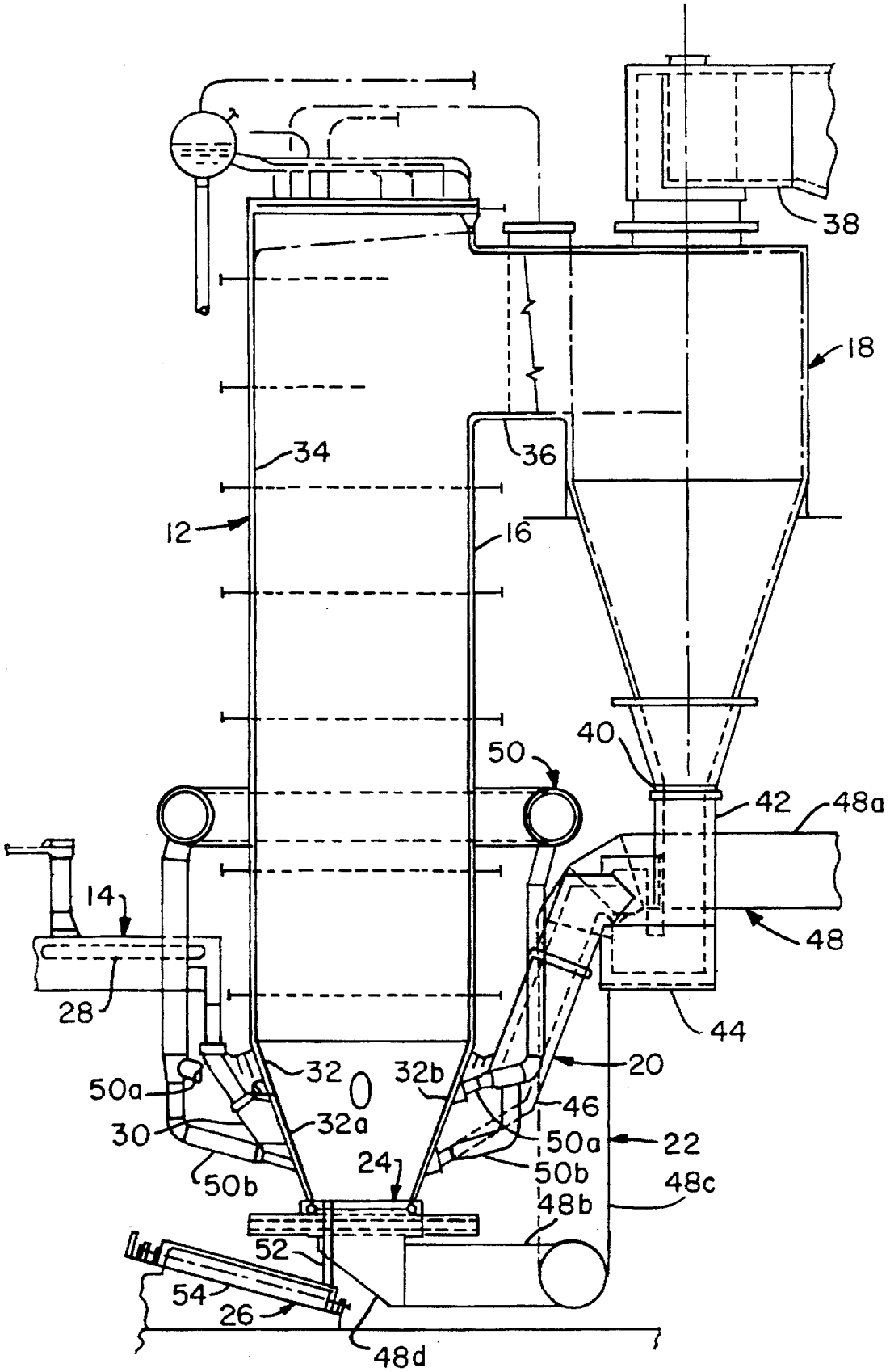
FIG. 2 is a side elevational view, partially in section, of a circulating fluid bed steam generator of the type with which the method, in accordance with the present invention, of enhancing the minimization of $NO_x$ formation within a circulating fluid bed steam generator can be utilized.

Referring next to FIG. 2 of the drawing, there is illustrated therein a circulating fluid bed steam generator, denoted generally by the reference numeral 12, of the type with which the method, in accordance with the present invention, of enhancing the minimization of $NO_x$ formation in a circulating fluid bed steam generator may be utilized. For purposes of the discussion thereof herein, the circulating fluid bed steam generator 12 may be considered to encompass a plurality of components. To this end, the circulating fluid bed steam generator 12, as illustrated in FIG. 2 of the drawing, includes fuel feed means, denoted generally by the reference numeral 14; the furnace, denoted generally by the reference numeral 16; the cyclone, denoted generally by the reference numeral 18; ash return means, denoted generally by the reference numeral 20; air supply means, denoted generally by the reference numeral 22; fluidizing grate means, denoted generally by the reference numeral 24; and ash removal means, denoted generally by the reference numeral 26.

Continuing with the description of the circulating fluid bed steam generator 12 as illustrated in FIG. 2 of the drawing, the fuel feed means 14 thereof is operative to effectuate the feeding of fuel into the furnace 16 of the circulating fluid bed steam generator 12. To this end, the fuel feed means 14 includes a fuel feeder, denoted in the drawing by the reference numeral 28, on to which properly sized solid fuel is deposited from a suitable source of supply thereof, which is not shown in the drawing in the interest of maintaining clarity of illustration therein. In known fashion the fuel feeder 28 is operative to transport the properly sized solid fuel, as best understood with reference to FIG. 4 of the drawing, to a plurality of fuel chutes, each denoted for ease of identification in the drawing by the same reference numeral, i.e., reference numeral 30. From the fuel chutes 30 the fuel is then fed therefrom into the interior of the furnace 16 of the circulating fluid bed steam generator 12. Further reference will be had to the fuel chutes 30 hereinafter.

Turning next to a consideration of the furnace 16 of the circulating fluid bed steam generator 12, it is within the lower portion, denoted by the reference numeral 32 in FIG. 2, of the furnace 16 that the fuel, which is fed thereinto from the fuel chutes 30, is combusted, as will be described more fully hereinafter. The gases that are generated as a consequence of the combustion of fuel within the lower portion 32 of the furnace 16 rise up through the upper portion, denoted by the reference numeral 34 in FIG. 2, of the furnace 16 and eventually exit therefrom, as depicted by the reference numeral 36 in FIG. 2, whereupon the gases enter the cyclone 18. In the course of their flow upwardly within the furnace 16, these gases in known fashion give up some of the heat associated therewith. To this end, at least some of the upper portion 34 of the furnace 16 is in the form of waterwalls through which water is made to flow, such that there is heat transfer between the water that flows through the waterwalls of the furnace 16 and the hot gases of combustion as these gases traverse the interior of the furnace 16 prior to exiting from the furnace 16 to the cyclone 18 whereby the water is thus converted to steam.

The cyclone 18 in turn is designed so as to be operative to effect the separation of solids that are entrained in the hot gases, which exit at 36 from the furnace 16 and enter the cyclone 18. Namely, in a manner well-known to those in the industry those solids entrained in the hot gases that are larger than a predetermined size are separated in conventional fashion from the hot gases during the passage of the hot gases through the cyclone 18. Furthermore, after those solids that are larger than a predetermined size have been separated from the hot gases within the cyclone 18, the hot gases are then made to exit from the cyclone 18 through the outlet thereof denoted by the reference numeral 38 in FIG. 2, whereas the solids that are larger than a predetermined size, which have been separated from the hot gases during the passage of the hot gases through the cyclone 18, exit from the cyclone 18 through the outlet thereof denoted by the reference numeral 40 in FIG. 2.

The solids exiting from the cyclone 18 through the outlet 40 thereof are then recycled by means of the ash return means 20 to the lower portion 32 of the furnace 16. In accordance with the illustrated embodiment thereof, the ash return means 20 is depicted as comprising a seal pot ash return. To this end, the ash return means 20 consists of a first downwardly extending leg, denoted by the reference numeral 42, having one end thereof connected in fluid flow relation with the outlet 40 of the cyclone 18; seal pot means, denoted by the reference numeral 44, having the other end of the first downwardly extending leg 42 connected in fluid flow relation therewith; and a second downwardly extending leg, denoted by the reference numeral 46, having one end thereof connected in fluid flow relation with the seal pot means 44 and the other end thereof connected in fluid flow relation With the lower portion 32 of the furnace 16. The mode of operation of the ash return means 20 is such that the solids after exiting from the cyclone 18 through the outlet 40 thereof enter the first downwardly extending leg 42 and flow therethrough to the seal pot means 44. From the seal pot means 44 the solids enter the second downwardly extending leg 46 and after flowing therethrough enter the lower portion 32 of the furnace 16. The seal pot means 44 in known fashion controls the flow therethrough of solids from the first downwardly extending leg 42 to the second downwardly extending leg 46 and thereby also controls the flow, i.e., the amount, of solids that are being recycled from the cyclone 18 to the lower portion 32 of the furnace 16.

Inasmuch as the nature of the construction and the mode of operation of the air supply system that a circulating fluid bed steam generator needs to embody when the method, in accordance with the present invention, of enhancing the minimization of $NO_x$ formation therewithin is being utilized therewith will be discussed in considerable detail hereinafter, it is believed that the following brief description of the air supply means 22 will suffice for now. Thus, in accordance with the illustration thereof in FIG. 2 of the drawing the nature of the construction of the air supply means 22 is such that the air supply means 22 is designed so as to be operative to supply both primary air and combustion, i.e., secondary, air to the circulating fluid bed steam generator 12.

Continuing, although not depicted in the drawing in the interest of maintaining clarity of illustration therein, it is to be understood that the air supply means 22 is suitably connected in fluid flow relation with a suitable source of supply of air, e.g., a fan of conventional construction, etc. This suitable source of supply of air (not shown) is designed to function as a source of supply of primary air as well as a source of supply of combustion, i.e., secondary, air. As such, this suitable source of supply of air (not shown) is connected in fluid flow relation with the primary air duct, denoted generally by the reference numeral 48 in FIG. 2, and is connected in fluid flow relation with the combustion, i.e., secondary, air duct, denoted generally by the reference numeral 50 in FIG. 2. The primary air duct 48 is designed to be operative to feed the air received thereby from the suitable source of supply thereof (not shown) to the fluidizing grate means 24 from whence in a conventional manner this air is injected in the form of primary, i.e., fluidizing, air into the lower portion 32 of the furnace 16. To this end, the primary air duct 48, in accordance with the illustration thereof in FIG. 2, includes first and second horizontally extending sections, denoted by reference numerals 48*a* and 48*b*, respectively; a downwardly extending section, denoted by the reference numeral 48*c*, which interconnects the first horizontally extending section 48*a* in fluid flow relation with the second horizontally extending section 48*b*; and an upwardly extending section, denoted by the reference numeral 48*d*, which interconnects the second horizontally extending section 48*b* in fluid flow relation with the fluidization grate means 24.

As regards the secondary air duct 50, the secondary air duct 50 is designed to be operative to feed the combustion air received thereby from the suitable source of supply thereof (not shown) into the lower portion 32 of the furnace 16 in a first vertical plane in the form of upper level secondary air and in a second vertical plane in the form of lower level secondary air. To this end, the secondary air duct 50, in accordance with the illustration thereof in FIG. 2, includes first downwardly extending duct means, denoted by the reference numeral 50*a*, by means of which the upper level secondary air is fed to the lower portion 32 of the furnace 16, and second downwardly extending duct means, denoted by the reference numeral 50*b*, by means of which the lower level secondary air is fed to the lower portion of the furnace 16.

The remaining one of the components of the circulating fluid bed steam generator 12 that has yet to be described herein is the ash removal means 26, which will now be described herein. The ash removal means 26 is designed to be operative to effect the removal of ash, as required, from the lower portion 32 of the furnace 16 of the circulating fluid bed steam generator 12. To this end, as best understood with reference to FIG. 2 of the drawing, the ash removal means 26 includes a downwardly extending leg, denoted by the reference numeral 52, and screw conveyor means, denoted by the reference numeral 54. In accord with the mode of operation, as is well-known to those in the industry, of the ash removal means 26, when ash is required to be removed from the circulating fluid bed steam generator 12 this ash is made to enter the downwardly extending leg 52 from the lower portion 32 of the furnace 16. After flowing through the downwardly extending leg 52, the ash, which it is desired to have removed from the lower portion 32 of the furnace 16, is received by the screw conveyor means 54. The screw conveyor means 54 is designed to be operative to effect in a conventional fashion the discharge from the circulating fluid bed steam generator 12 of the ash received by the screw conveyor means 54 that is removed from the lower portion 32 of the furnace 16.

From the foregoing description thereof and the illustration thereof in the drawing, it should thus be readily apparent that the circulating fluid bed steam generator 12 embodies two levels of secondary air, i.e., an upper level of secondary air and a lower level of secondary air. Further, it should be readily apparent therefrom that the secondary air, which is designed to be injected into the lower portion 32 of the furnace 16 through the front wall, denoted by the reference numeral 32*a*, thereof is supplied thereto by means of the first downwardly extending duct 50*a* in the case of the upper level of secondary air and by means of the second downwardly extending duct 50*b* in the case of the lower level of secondary air. Moreover, as can be seen from a reference to FIG. 2 of the drawing the upper level of secondary air is injected through the front wall 32*a* of the lower portion 32 of the furnace 16 above the location on the front wall 32*a* whereat the fuel enters the lower portion 32 of the furnace 16 from the fuel chutes 30. On the other hand, the lower level of secondary air, as can be seen from a reference to FIG. 2 of the drawing, is injected through the front wall 32*a* of the lower portion 32 of the furnace 16 below the location on the front wall 32*a* whereat the fuel enters the lower portion 32 of the furnace 16 from the fuel chutes 30. In addition to the upper level of secondary air and the lower level of secondary air that are injected into the lower portion 32 of the furnace 16 through the front wall 32*a* thereof, in accordance with the embodiment of the circulating fluid bed steam generator 12 illustrated in FIG. 2 of the drawing both an upper level of secondary air and a lower level of secondary air are also injected through the rear wall, denoted by the reference numeral 32*b*, of the lower portion 32 of the furnace 16. The upper level of secondary air, which is injected through the rear wall 32*b* into the lower portion 32 of the furnace 16, preferably is injected coplanar with the upper level of secondary air, which is injected through the front wall 32*a* into the lower portion 32 of the furnace 16. Likewise, the lower level of secondary air, which is injected through the rear wall 32*b* into the lower portion 32 of the furnace 16, preferably is injected coplanar with the lower level of secondary air, which is injected through the front wall 32*a* into the lower portion of the furnace 16. Although as illustrated in the drawing, the circulating fluid bed steam generator 12 is designed so that fuel is fed only through the front wall 32*a* into the lower portion 32 of the furnace 16, it is to be understood that fuel could also be fed through the rear wall 32*b* into the lower portion 32 of the furnace 16 without departing from the essence of the invention.

Figure 3:
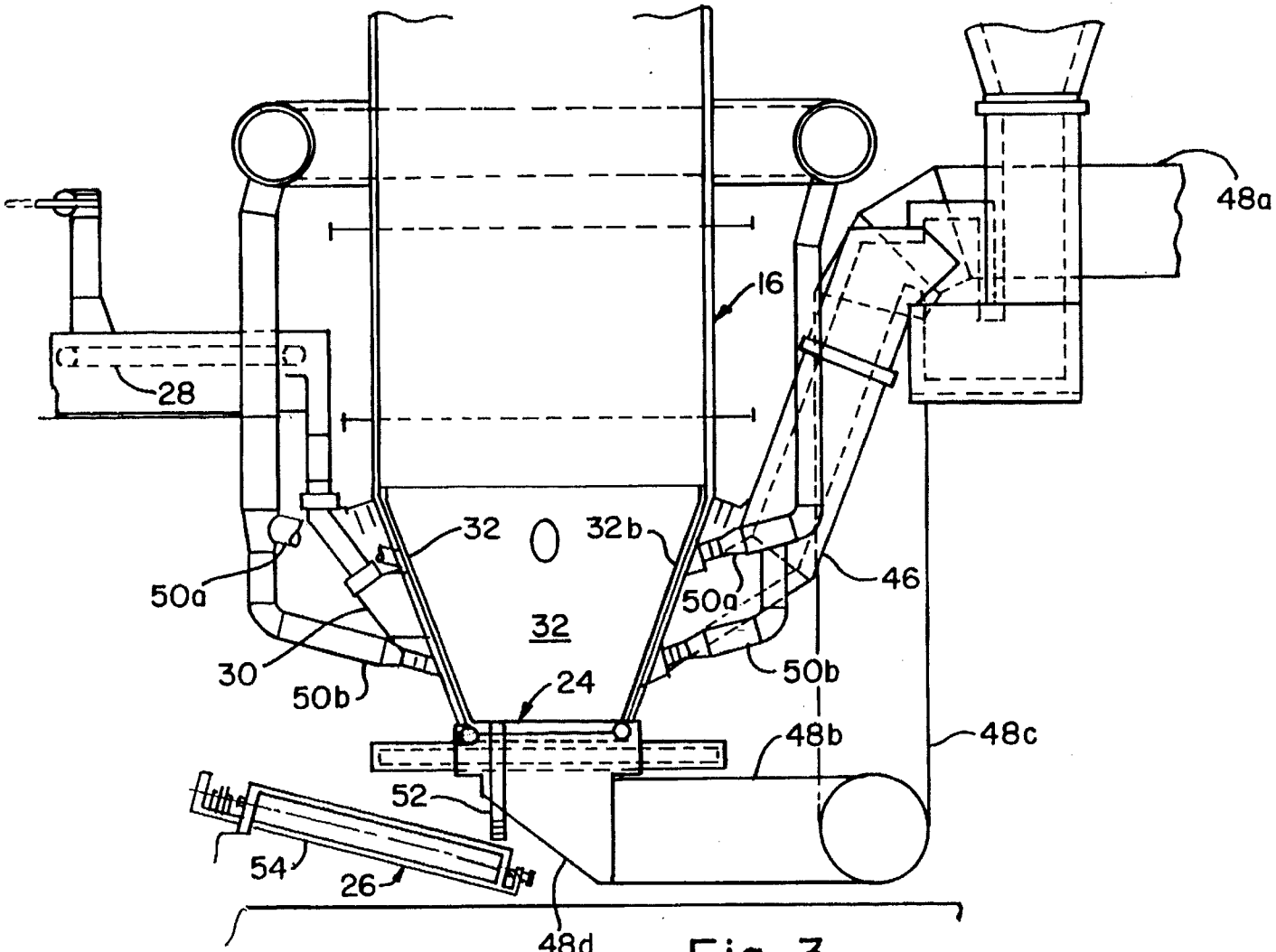
FIG. 3 is a side elevational view on a larger scale of the lower portion of the circulating fluid bed steam generator illustrated in FIG. 2 of the type with which the method, in accordance with the present invention, of enhancing the minimization of $NO_x$ formation within a circulating fluid bed steam generator can be utilized.

Reference will be had next to FIG. 3 of the drawing wherein the lower portion 32 of the furnace 16 is to be found illustrated on an enlarged scale whereby the features thereof are shown in greater detail than in FIG. 2. As best understood from a reference to FIG. 3 of the drawing, the primary air that is injected into the lower portion 32 of the furnace 16 through the fluidizing grate means 24; the lower level of secondary air that is injected through both the front wall 32*a* and the rear wall 32*b* into the lower portion 32 of the furnace 16; the fuel that is fed through the front wall 32*a* into the lower portion 32 of the furnace 16; the upper level of secondary air that is injected through both the front wall 32*a* and the rear wall 32*b* into the lower portion 32 of the furnace 16 are, respectively, located sequentially as viewed with respect to the vertical axis of the furnace 16. Such an arrangement of the primary air, the fuel and the two levels of secondary air, i.e., the sequential location thereof in the vertical direction, is commonplace in the industry. Based on such an arrangement of the primary air, fuel and two levels of secondary air, about 50% to 60% of the total amount of air that is supplied to the circulating fluid bed steam generator 12 is made to enter the lower portion 32 of the furnace 16 through the fluidizing grate means 24. Essentially all of the remaining 40% to 50% of the total amount of air that is supplied to the circulating fluid bed steam generator 12 is made to enter the lower portion 32 of the furnace 16 as upper level secondary air and lower level secondary air, although some very minimal amount of this remaining 40% to 50% of the total amount of air may enter the circulating fluid bed steam generator 12 through other means.

Figure 4:
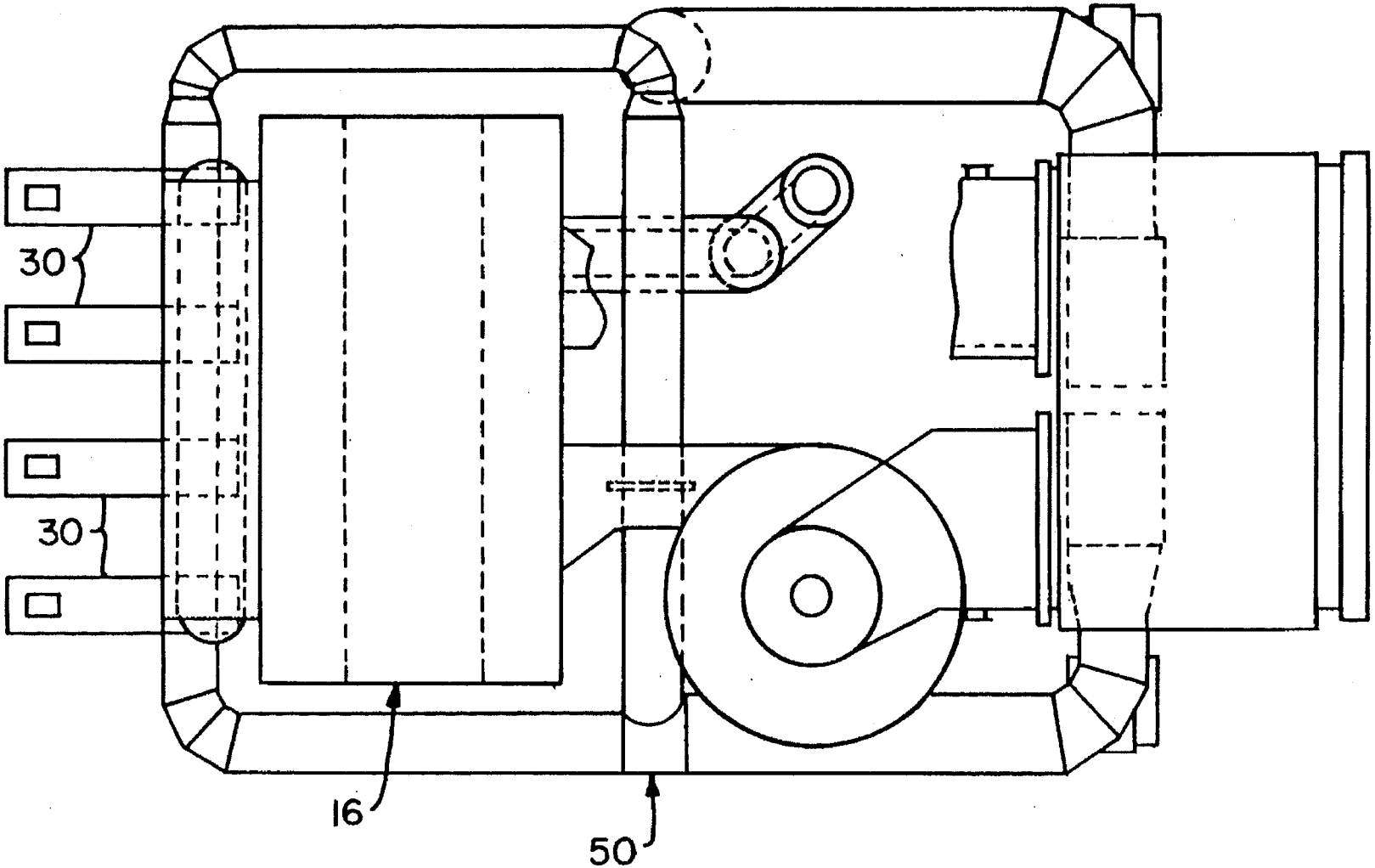
FIG. 4 is a plan view of the circulating fluid bed steam generator illustrated in FIG. 2 of the type with which the method, in accordance with the present invention, of enhancing the minimization of $NO_x$ formation within a circulating fluid bed steam generator can be utilized.
Figure 5:
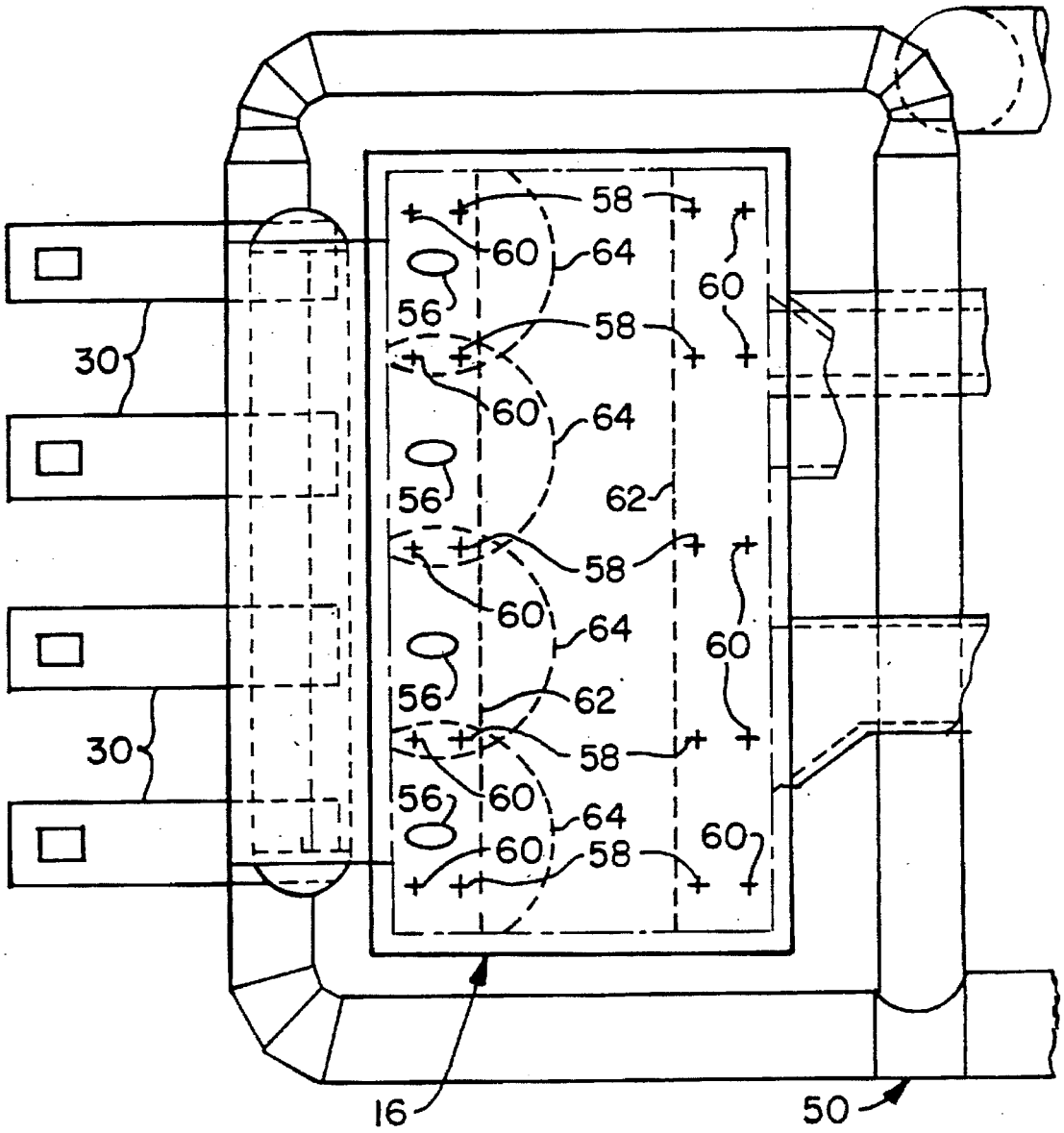
FIG. 5 is a plan view on a larger scale of a portion of the circulating fluid bed steam generator illustrated in FIG. 2 of the type with which the method, in accordance with the present invention, of enhancing the minimization of $NO_x$ formation within a circulating fluid bed steam generator can be utilized.

A discussion will now be had of FIGS. 4 and 5 of the drawing. In this regard, FIG. 4 as noted previously herein is a plan view of the circulating fluid bed steam generator 12 that is depicted in FIG. 2 as well as other components, whereas FIG. 5 is a plan view, similar to FIG. 4, illustrated on an enlarged scale such that the features depicted therein are shown in greater detail than in FIG. 4. With reference in particular to FIG. 5 of the drawing, the entrance of the fuel feed chutes 30 to the lower portion 32 of the furnace 16 are depicted in FIG. 5 for ease of reference thereto by the dark ellipses, which are each denoted in FIG. 5 by the same reference numeral 56. Also, for ease of reference thereto the points of injection of the lower level secondary air have been depicted in FIG. 5 by means of the innermost rows of crosses with each of the individual ones of these crosses being denoted in FIG. 5 by the same reference numeral 58, while for ease of reference thereto the points of injection of the upper level secondary air have been depicted in FIG. 5 by means of the outermost rows of crosses with each of the individual ones of these crosses being denoted in FIG. 5 by the same reference numeral 60. Finally, the area in which primary air is made to enter the lower portion 32 of the furnace 16 from the fluidizing grate means 24 is identified for ease of reference thereto in FIG. 5 of the drawing by the two spaced dash lines, each denoted by the same reference numeral 62 in FIG. 5. Although the location of the points of injection of the lower level secondary air and of the upper level secondary air are depicted in FIG. 5 of the drawing by the crosses denoted therein by the reference numerals 58 and 60, respectively, it is to be understood that the actual placement of these points of injection may in actuality vary somewhat from that graphically depicted in FIG. 5. However, any such variation between the actual placement thereof and the graphical depiction thereof in FIG. 5 is not deemed to be significant either from the standpoint of the applicability to circulating fluid bed steam generators, such as the circulating fluid bed steam generator 12 illustrated in the drawing of the instant application, or insofar as concerns the ability of one to acquire an understanding of the method of the present invention.

As mentioned herein previously, it has been found that circulating fluid bed steam generators, generally speaking, do not have good lateral fuel/air mixing characteristics. An understanding of this can be had with reference to FIG. 5 of the drawing. For this purpose, the limits of lateral fuel mixing have been graphically depicted, for ease of understanding, in FIG. 5 by means of the dotted line circles, each denoted therein by the same reference numeral 64. Thus, as should be readily understandable from a reference to FIG. 5 of the drawing, the areas within the dotted line circles 64, are areas that are fuel rich. To this end, tests have demonstrated the fact that within the lower portion 32 of the furnace 16 the lateral mixing of fuel and air may occur only up to approximately six feet from the point of fuel entry, i.e., from the entrances 56 of the fuel feed chutes 30. As a consequence of this, the fuel, which enters the lower portion 32 of the furnace 16 at each of the fuel feed chute entrances 56, tends to form a plume in the vertical direction within the furnace 16. Moreover, based on test measurements it has been found that this plume remains fuel rich and has high carbon monoxide concentrations. Further, it has been found that at the level of the fuel feed chutes 30, the local stoichiometry is very substoichiometric and, as would be expected from the curve 10 of FIG. 1, much of the fuel nitrogen forms ammonia that in turn upon later combustion within the furnace 16 leads to the formation of additional $NO_x$. In addition, it should also be readily apparent from a reference to FIG. 5 of the drawing that there exists a relatively large area within the lower portion 32 of the furnace 16, i.e., that area lying outside of the dotted line circles 64 and, therefore, outside of the aforedescribed fuel plume. This area, i.e., that lying outside of the dotted line circles 64, is extremely air rich since the majority of the fuel does not migrate laterally thereto. Thus, in this area, i.e., the area lying outside of the dotted line circles 64, any fuel nitrogen that is released therewithin is readily converted directly to $NO_x$.

Figure 6:
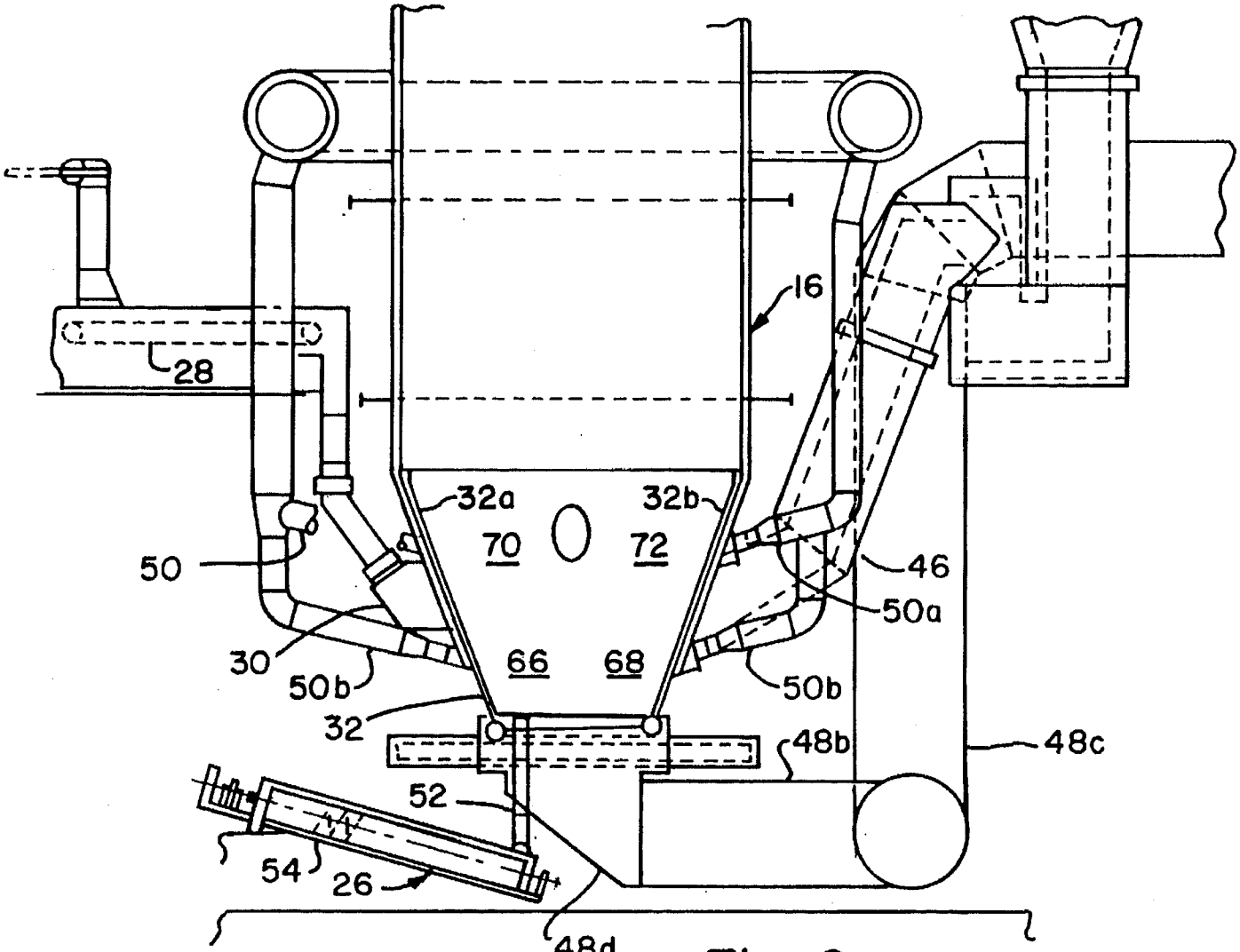
FIG. 6 is a side elevational view on a larger scale, similar to FIG. 3, of the lower portion of the circulating fluid bed steam generator illustrated in FIG. 2 of the type with which the method, in accordance with the present invention, of enhancing the minimization of $NO_x$ formation within a circulating fluid bed steam generator can be utilized, but depicting the lower portion of the circulating fluid bed steam generator broken up into a plurality of both vertical zones and horizontal zones.

Turning now to FIG. 6 of the drawing, FIG. 6 is essentially the same as FIG. 3 of the drawing but for the fact that in FIG. 6 the lower portion 32 of the furnace 16 is shown as being divided up into four zones, i.e., zone 1, denoted generally therein by the reference numeral 66; zone 2, denoted generally therein by the reference numeral 68; zone 3, denoted generally therein by the reference numeral 70; and zone 4, denoted generally therein by the reference numeral 72. The lower portion 32 of the furnace 16 is depicted in FIG. 6 as being divided up into the aforedescribed four zones in order to thereby facilitate the setting forth herein of an explanation of how $NO_x$ is generated within circulating fluid bed steam generators such as the circulating fluid bed steam generator 12 illustrated in the drawing of the instant application. For purposes of the explanation herein of how $NO_x$ is generated within circulating fluid bed steam generators, both the vertical and horizontal staging aspects of a circulating fluid bed steam generator such as the circulating fluid bed steam generator 12 are considered to be combined. To this end, set forth hereinafter is an illustrative example of the manner in which $NO_x$ generation occurs within a circulating fluid bed steam generator such as, by way of exemplification and not limitation, a circulating fluid bed steam generator that embodies the construction of the circulating fluid bed steam generator 12. Note is also made here of the fact that this illustrative example is predicated on the following assumptions: 50% of the total amount of air that enters the lower portion 32 of the furnace 16 enters as fluidizing, i.e., primary, air through the fluidizing grate means 24; 25% of the total amount of air that enters the lower portion 32 of the furnace 16 enters as lower level secondary air, while the remaining 25% of the total amount of air that enters the lower portion 32 of the furnace 16 enters as upper level secondary air; 100% of the fuel burned within the furnace 16 is burned on the one-half of the plan area of the furnace 16 closest to the fuel feed chute entrances 56; and the overall stoichiometry within the furnace 16 is 1.2, i.e., the furnace 16 is provided with 20% excess air.

Thus, based on the foregoing assumptions zone 1, i.e., the area within the lower portion 32 of the furnace 16 denoted by the reference numeral 66, has one-half of the primary air, one-half of the lower level secondary air and all of the fuel combustion. As such, the stoichiometry locally within zone 1, i.e., area 66, is 45%. Zone 3, i.e., the area within the lower portion 32 of the furnace 16 denoted by the reference numeral 70, has one-half of the upper level secondary air as well as the gases and fuel that flow upwardly thereinto from zone 1, i.e., the area 66. As such, the stoichiometry locally within zone 3, i.e., area 70, is 60%. Finally, zone 2, i.e., the area within the lower portion 32 of the furnace 16 denoted by the reference numeral 68, and zone 4, i.e., the area within the lower portion 32 of the furnace 16 denoted by the reference numeral 72, are each essentially only air.

While this illustrative example may seem to be somewhat extreme, nevertheless it does show that the area 66 where the fuel is combusted, i.e., zone 1, is heavily reducing, i.e., locally very substoichiometric, to the point where the nitrogen in the fuel is released as $N_2$ and ammonia. Further, it should be apparent from the foregoing illustrative example that the gas from zone 1, i.e., area 66, is somewhat oxidized in zone 3, i.e., area 70, because of the upper level secondary air but is still very reducing, i.e., substoichiometric. In the upper level of the lower portion 32 of the furnace 16, the mixing of reducing gases from zone 3, i.e., area 70, with oxidizing gases from zone 4, i.e., area 72, will provide complete combustion but will also oxidize to $NO_x$ the ammonia produced in zone 3, i.e., area 70. Thus, to summarize, the arrangement of air and fuel firing according to the illustrative example set forth hereinabove, which is typical of that employed heretodate in circulating fluid bed steam generators, clearly does not produce the lowest possible $NO_x$ formation that is attainable from a circulating fluid bed steam generator. Principally, this is due to the existence of heavy reducing, i.e., very substoichiometric conditions, within zone 1, i.e., area 66, which results in the fuel in this area reacting to produce ammonia. As shown by the curve 10 in FIG. 1 of the drawing, operating in a region that produces ammonia is not optimal from the standpoint of minimizing $NO_x$ formation.

Figure 7:
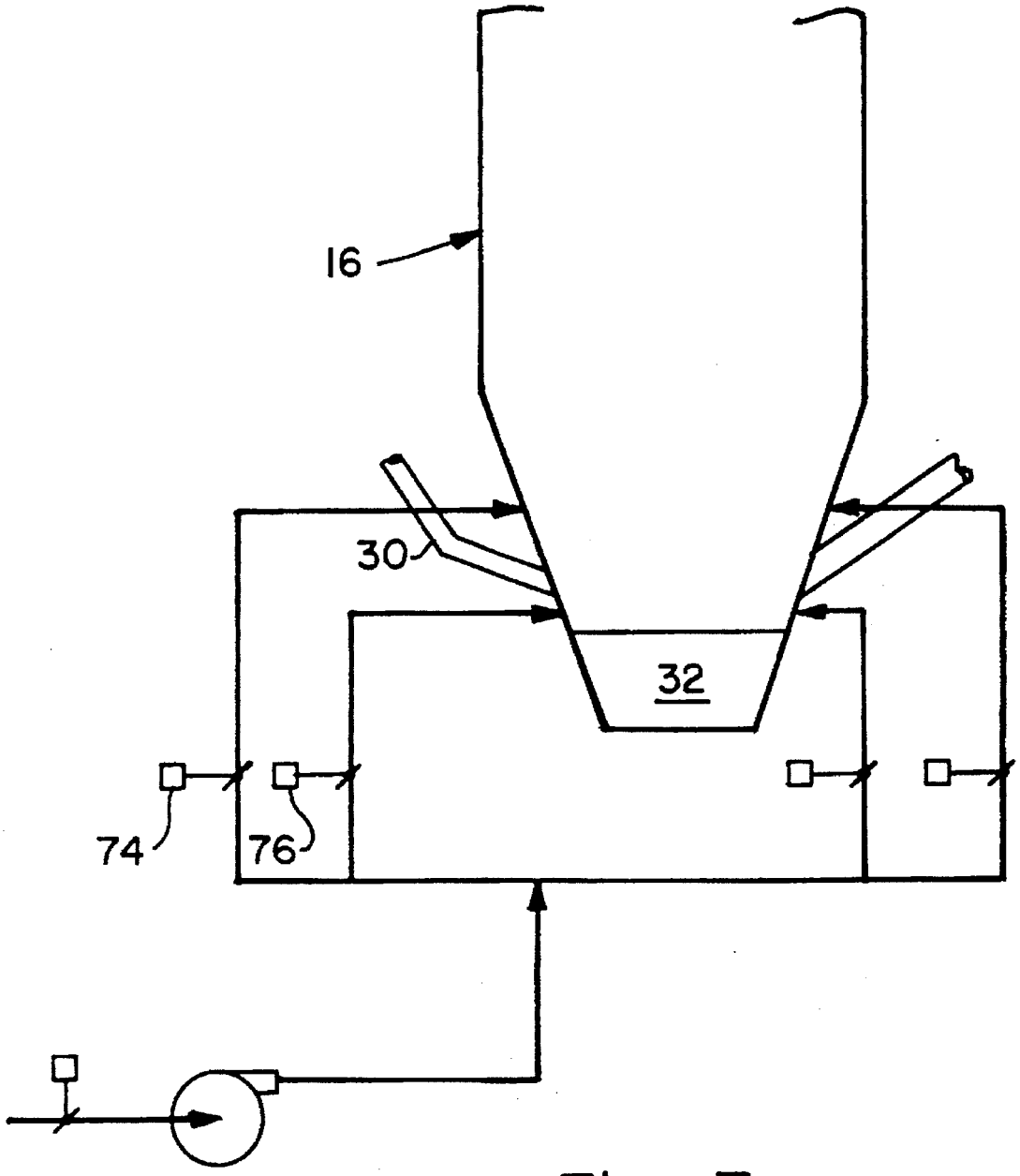
FIG. 7 is a diagrammatic representation of the air supply system with which a circulating fluid bed steam generator is equipped when the method, in accordance with the present invention, of enhancing the minimization of $NO_x$ formation in a circulating fluid bed steam generator is being utilized.
Figure 8:
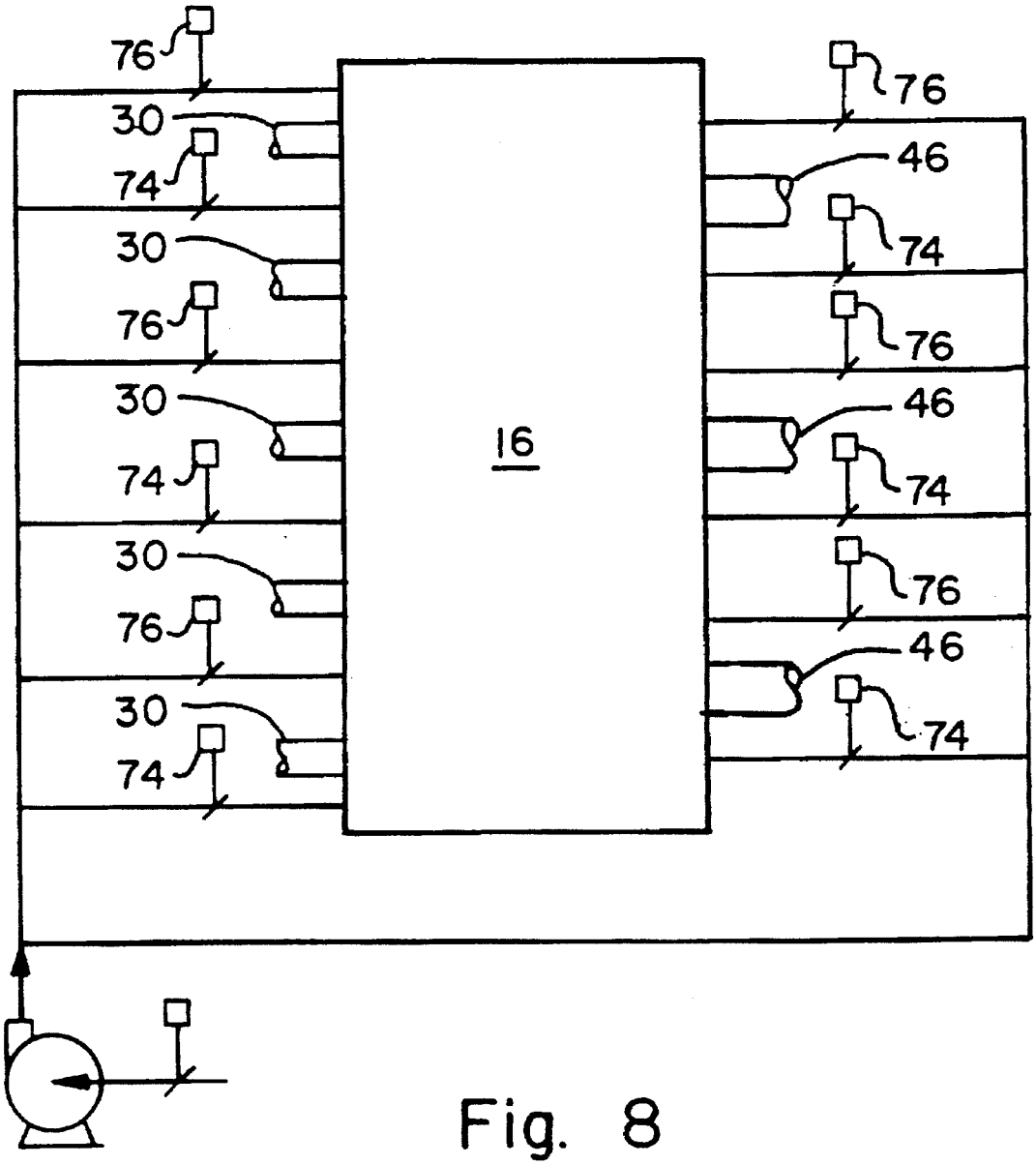
FIG. 8 is a plan view of the diagrammatic representation of the air supply system illustrated in FIG. 7 with which a circulating fluid bed steam generator is equipped when the method, in accordance with the present invention, of enhancing the minimization of $NO_x$ formation in a circulating fluid bed steam generator is being utilized.

In contrast to the foregoing, the approach employed in accordance with the method, which is the subject of the present invention, for purposes of enhancing the minimization of $NO_x$ formation is to not only stage combustion vertically, i.e., along the height of the furnace 16, but also laterally, i.e., from side-to-side, within the furnace 16. Tests have shown that by doing so overall $NO_x$ is reduced below the levels achievable when only vertical staging is employed. Lateral as well as vertical staging of fuel/air combustion is accomplished in accordance with the method of the present invention by locally controlling the air flow to strategic points of injection of both upper level secondary air and lower level secondary air in order to thereby control the stoichiometry locally within the lower portion 32 of the furnace 16. To this end, in accordance with the best mode embodiment of the invention and as will be discussed further hereinafter in connection with the description of FIGS. 7 and 8 of the drawing, the upper level secondary air as well as the lower level secondary air are each individually dampered upstream of their respective points of injection into the lower portion 32 of the furnace 16, i.e., along the periphery of the furnace 16, in order to thereby effectuate a distribution of the air flow into the lower portion 32 of the furnace 16. In this way, i.e., by controlling the local stoichiometry in all areas of the furnace 16 of the circulating fluid bed steam generator $NO_x$ formation therewithin is minimized. Thus, by employing the method of enhancing the minimization of $NO_x$ formation in a circulating fluid bed steam generator in accordance with the present invention, it is possible to achieve $NO_x$ emissions levels from a circulating fluid bed steam generator, such as the circulating fluid bed steam generator 12, with which the method of the present invention is being employed comparable to that achievable from a circulating fluid bed steam generator in which only vertical staging is being employed but only when the latter circulating fluid bed steam generator is also equipped with selective non-catalytic $NO_x$ reduction equipment. Namely, in order to attain the $NO_x$ emissions levels achievable from a circulating fluid bed steam generator with which the method of the present invention is employed ammonia must be used to lower $NO_x$ emissions levels from a circulating fluid bed steam generator in which the method of the present invention is not employed, i.e., from a circulating fluid bed steam generator in which only vertical staging is employed.

To reiterate, in order to achieve minimization of $NO_x$ formation within a circulating fluid bed steam generator it is essential that the stoichiometries locally in zone 1, i.e., area 66, and zone 3, i.e., area 70, be kept, as shown by the curve 10 in FIG. 1, within a range of 70% stoichiometry to 90% stoichiometry. Accordingly, in accord with the method of the present invention of enhancing the minimization of $NO_x$ formation in a circulating fluid bed steam generator the upper level secondary air as well as the lower level secondary air are biased, as needed, to the front wall 32*a* of the lower portion 32 of the furnace 16 in order to thereby raise the local stoichiometries such that the local stoichiometries in zone 1, i.e., area 66, and zone 3, i.e., area 70, are within the range of 70% stoichiometry to 90% stoichiometry. To this end, by raising the local stoichiometries in zone 1, i.e., area 66, and zone 3, i.e., area 70, the formation of ammonia is minimized and as a consequence thereof the amount of ammonia formed that is subject to subsequent oxidation to $NO_x$ is concomitantly minimized. In addition to enhancing the minimization of $NO_x$ formation within a circulating fluid bed steam generator there are also other benefits derived from the use of the present invention. Namely, it has been found that as a consequence of the use of the present invention carbon loss, volatile organic components (VOC) and carbon monoxide formation are also minimized due to the higher air/fuel mixture ratio, and that $SO_x$ capture is enhanced due to the more rapid oxidation of fuel sulfur to $SO_x$.

By way of illustration of how the method of the present invention is operative to enhance the minimization of $NO_x$ formation in a circulating fluid bed steam generator 12 the following illustrative example is provided herein. For purposes of this illustrative example the following assumptions have been made: 50% of the total amount of air that enters the lower portion 32 of the furnace 16 enters as fluidizing, i.e., primary, air through the fluidizing grate means 24; 40% of the total amount of air that enters the lower portion 32 of the furnace 16 enters entirely through the front wall 32*a* as lower level secondary air, while the remaining 10% of the total amount of air that enters the lower portion 32 of the furnace 16 enters as upper level secondary air; 100% of the fuel burned within the furnace 16 is burned on the one-half of the plan area of the furnace 16 closest to the fuel feed chute entrances 56; and the overall stoichiometry within the furnace 16 is 1.2, i.e., the furnace 16 is provided with 20% excess air.

Thus, based on the foregoing assumptions zone 1, i.e., the area within the lower portion 32 of the furnace 16 denoted by the reference numeral 66, has one-half of the fluidizing, i.e., primary, air, all of the lower level secondary air and all of the fuel combustion. As such, the stoichiometry locally within zone 1, i.e., area 66, is 70%. Zone 3, i.e., the area within the lower portion 32 of the furnace 16 denoted by the reference numeral 70, has one-half of the upper level secondary air as well as the gases and fuel that flow upwardly thereinto from zone 1, i.e., the area 66. As such, the stoichiometry locally within zone 3, i.e., area 70, is 75%. Finally, zone 2, i.e., the area within the lower portion 32 of the furnace 16 denoted by the reference numeral 68, and zone 4, i.e., the area within the lower portion 32 of the furnace 16 denoted by the reference numeral 72, are essentially only air.

Thus, it should be readily apparent from the foregoing illustrative example that if the lower level secondary air, which would otherwise enter the lower portion 32 of the furnace 16 through the rear wall 32*b*, is instead fed through the front wall 32*a* as lower level secondary air, then the stoichiometry locally within each of zones 1 and 3 will be within the desired range of 70% stoichiometry to 90% stoichiometry such that the formation therewithin of ammonia will be minimized and concomitantly the subsequent oxidation of ammonia to $NO_x$ will also be minimized. In actual practice the method of the present invention encompasses many combinations of vertical and horizontal air biasing that may be employed for purposes of effectuating the minimization of $NO_x$ formation in circulating fluid bed steam generators. Moreover, in accordance with the method of the present invention, these combinations of vertical and horizontal air biasing are designed to be optimized on a case-by-case basis based on the reactivity of the fuel being burned in a particular circulating fluid bed steam generator as well as based on geometrical factors specific to the particular circulating fluid bed steam generator in which it is desired to utilize the method of the present invention for purposes of minimizing the level of $NO_x$ emissions therefrom.

To thus recapitulate, it has been found that the minimization of $NO_x$ formation in a circulating fluid bed steam generator can be enhanced by staging, both vertically and horizontally, the combustion of the fuel and air therewithin. To this end, fluidizing, i.e., primary, air is fed into the lower portion 32 of the furnace 16 through the fluidizing grate means 24 to provide air to fluidize the fuel, sorbent and ash in the furnace 16. Combustion, i.e., secondary, air is fed to the furnace 16 as lower level secondary air and upper level secondary air to provide the air required for proper combustion and for $NO_x$ formation control. Fuel enters the furnace 16 through fuel chutes 30, which are located between the points of injection of the lower level secondary air and the points of injection of the upper level secondary air. Fuel chutes 30 and points of injection of upper level secondary air as well as points of injection of lower level secondary air can be located, without departing from the essence of the present invention, along the horizontal plane on any one or more of the walls, e.g., front wall 32*a*, rear wall 32*b*, etc., of the furnace 16.

In accordance with the method of the present invention, in order to enhance the minimization of $NO_x$ formation in a circulating fluid bed steam generator such as the circulating fluid bed steam generator 12 illustrated in the drawing of the instant application, the upper level secondary air flow and the lower level secondary air flow are each controlled both in the vertical direction and in the horizontal direction. The objective in doing so is to maintain a local stoichiometry of between 70% stoichiometry and 90% stoichiometry, i.e., a local stoichiometry, which in accordance with the curve 10 in FIG. 1 is not conducive to ammonia formation, i.e., low stoichiometry, or is not conducive to direct $NO_x$ formation, i.e., high stoichiometry. In accordance with the best mode embodiment of the invention and as best understood with reference to FIGS. 7 and 8 of the drawing, this is accomplished by biasing both the upper level secondary air flow and the lower level secondary air flow using local dampers, the latter being denoted by the reference numerals 74 and 76, respectively, in FIGS. 7 and 8. As best understood with reference to FIG. 8 of the drawing, a plurality of such local dampers are preferably employed for this purpose, i.e., one local damper 74 associated with each point of injection of upper level secondary air and one local damper 76 associated with each point of injection of lower level secondary air. These local dampers 74 and 76 are designed to be operative such that through the use thereof, i.e., by the biasing of the secondary air flow as a consequence of the individual positioning thereof, the stoichiometry can be controlled locally within the furnace 16 to be within a range of 70% stoichiometry to 90% stoichiometry and, therefore, the minimization of $NO_x$ formation in the circulating fluid bed steam generator 12 can thereby be minimized.

By way of reiteration, some of the benefits to be achieved from the use of the method, in accordance with the present invention, of enhancing the minimization of $NO_x$ formation in circulating fluid bed steam generators are as follows. Staging in the horizontal plane as well as the vertical plane produces lower $NO_x$ formation than that attainable through staging in only the vertical plane. As a result, the use of selective non-catalytic $NO_x$ reduction equipment, which would otherwise be required when staging in only the vertical plane is employed, is rendered unnecessary. With the elimination of selective non-catalytic $NO_x$ reduction equipment a concomitant decrease in capital cost is realized as well as a concomitant decrease in operating cost associated with supplying the ammonia or urea otherwise required for the utilization of the selective non-catalytic $NO_x$ reduction equipment. Further, with the elimination of the need to use either ammonia or urea there is a concomitant elimination of the need to transport or to store hazardous chemicals, i.e., ammonia or urea, as well as a concomitant elimination of ammonia slip from the circulating fluid bed steam generator and of the potential for ammonia reaction with chlorides or $SO_3$ resulting in opacity. In summary, by utilizing the method of the present invention no additional circulating fluid bed steam generator related equipment is required and no additional costs are incurred.

Thus, in accordance with the present invention there has been provided a new and improved method for effectuating therewith the reduction of $NO_x$ emissions from a circulating fluid bed steam generator. Moreover, there has been provided in accord with the present invention such a new and improved method for effectuating therewith the reduction of $NO_x$ emissions from a circulating fluid bed steam generator wherein the reduction of $NO_x$ emissions from the circulating fluid bed steam generator is accomplished as a consequence of enhancing the minimization of $NO_x$ formation in the circulating fluid bed steam generator. Also, in accordance with the present invention there has been provided such a new and improved method for enhancing the minimization of $NO_x$ formation in a circulating fluid bed steam generator whereby the utilization thereof obviates the necessity of providing the circulating fluid bed steam generator with selective non-catalytic $NO_x$ reduction equipment. Further, there has been provided in accord with the present invention such a new and improved method of enhancing the minimization of $NO_x$ formation in a circulating fluid bed steam generator whereby the utilization thereof obviates the necessity of having to inject either ammonia or urea into the circulating fluid bed steam generator in order to thereby effectuate therewith the reduction of $NO_x$ from the circulating fluid bed steam generator. In addition, in accordance with the present invention there has been provided such a new and improved method of enhancing the minimization of $NO_x$ formation in a circulating fluid bed steam generator which is not disadvantageously characterized by the fact that the utilization thereof occasions ammonia slip from the circulating fluid bed steam generator since the utilization thereof obviates the necessity to inject into the circulating fluid bed steam generator either ammonia or urea from whence the ammonia slip would originate. Furthermore, there has been provided in accord with the present invention such a new and improved method of enhancing the minimization of $NO_x$ formation in a circulating fluid bed steam generator which is not disadvantageously characterized by the fact that the utilization thereof occasions the contamination of the ash thereof with ammonia or urea since the utilization thereof obviates the necessity to inject into the circulating fluid bed steam generator either ammonia or urea from whence the source of the contamination of the ash would originate. Additionally, in accordance with the present invention there has been provided such a new and improved method of enhancing the minimization of $NO_x$ formation in a circulating fluid bed steam generator which renders the circulating fluid bed steam generator much simpler to provide and operate since the utilization thereof obviates the necessity to provide the circulating fluid bed steam generator with any additional means that would otherwise be required in order to effectuate the removal of $NO_x$ from the circulating fluid bed steam generator to the same extent. Penultimately, there has been provided in accord with the present invention such a new and improved method of enhancing the minimization of $NO_x$ formation in a circulating fluid bed steam generator which renders the circulating fluid bed steam generator much less costly to provide and operate since the utilization thereof obviates the necessity to provide the circulating fluid bed steam generator with any additional means that would otherwise be required in order to effectuate the removal of $NO_x$ from the circulating fluid bed steam generator to the same extent. Finally, in accordance with the present invention there has been provided such a new and improved method of enhancing the minimization of $NO_x$ formation in a circulating fluid bed steam generator that is suitable for application in new circulating fluid bed steam generators and is equally suitable to be retrofitted for application in existing circulating fluid bed steam generators.

While one embodiment of my invention has been shown, it will be appreciated that modifications thereof, some of which have been alluded to hereinabove, may still be readily made thereto by those skilled in the art. I, therefore, intend by the appended claims to cover the modifications alluded to herein as well as all the other modifications which fall within the true spirit and scope of my invention.

What is claimed is:

1. A method of enhancing the minimization of $NO_x$ formation in a circulating fluid bed steam generator comprising the steps of:

a. providing a circulating fluid bed steam generator having a lower furnace portion;

b. injecting fuel into the lower furnace portion at a plurality of fuel feed points;

c. injecting into the lower furnace portion at a fluidizing air injection point fluidizing air for effectuating therewith the fluidization of the fuel;

d. injecting secondary air into the lower furnace portion at a plurality of secondary air injection points located adjacent the plurality of fuel feed points;

e. defining a plurality of individualized horizontally extending local zones within the lower furnace portion of the circulating fluid bed steam generator, each of the plurality of individualized horizontally extending local zones being defined by one of the plurality of fuel feed points and a corresponding one of the secondary air injection points; and f. biasing the secondary air in both the horizontal plane and the vertical plane so as to thereby maintain the stoichiometry in each of the plurality of individualized horizontally extending local zones within a range of 70% stoichiometry to 90% stoichiometry.

2. The method as set forth in claim 1 wherein the plurality of secondary air injection points are located below the plurality of fuel feed points.

3. The method as set forth in claim 1 wherein the plurality of secondary air injection points are located above the plurality of fuel feed points.

4. The method as set forth in claim 1 wherein some of the plurality of secondary air injection points are located below the plurality of fuel feed points and the remainder of the plurality of secondary air injection points are located above the plurality of fuel feed points.

5. The method as set forth in claim 4 wherein the biasing of the secondary air is accomplished by dampers.

6. The method as set forth in claim 4 wherein the biasing of the secondary air into the lower furnace portion at the plurality of secondary air injection points located below the plurality of fuel feed points is accomplished by means of a plurality of dampers with one of the plurality of dampers being located upstream of each one of the plurality of secondary air injection points located below the plurality of fuel feed points.

7. The method as set forth in claim 6 wherein the biasing of the secondary air into the lower furnace portion of the plurality of secondary air injection points located above the plurality of fuel feed points is accomplished by means of a plurality of dampers with one of the plurality of dampers being located upstream of each one of the plurality of secondary air injection points located above the plurality of fuel feed points.

8. The method as set forth in claim 1 wherein the lower furnace portion at the fluidizing air injection point embodies a grate and the fluidizing air is injected through the grate into the lower furnace portion.

* * * * *